US005428346A

United States Patent [19]

Franklin

[11] Patent Number: 5,428,346

[45] Date of Patent: Jun. 27, 1995

[54] THEFT ALARM ACTIVATING ABSORBENT PAD

[75] Inventor: Boyd M. Franklin, Boone, N.C.

[73] Assignee: Sealed Air Corporation, Saddle Brook, N.J.

[21] Appl. No.: 69,120

[22] Filed: May 28, 1993

[51] Int. Cl.[6] ..... G08B 13/14

[52] U.S. Cl. ..... 340/572; 206/204

[58] Field of Search ..... 340/572, 551, 693; 206/204; 239/56; 312/31

[56] References Cited

U.S. PATENT DOCUMENTS

| | | | |
|---|---|---|---|
| 2,774,060 | 12/1956 | Thompson | 340/572 |
| 3,292,080 | 12/1966 | Trikilis | 340/572 |
| 3,711,848 | 1/1973 | Martens | 340/572 |
| 4,065,753 | 12/1977 | Paul, Jr. | 340/572 X |
| 4,123,749 | 10/1978 | Hartmann et al. | 340/572 |
| 4,275,811 | 6/1981 | Miller | 206/204 |
| 4,686,516 | 8/1987 | Humphrey | 340/572 |
| 4,694,283 | 9/1987 | Reeb | 340/572 |
| 4,724,426 | 2/1988 | Lundberg | 340/551 |
| 5,276,431 | 1/1994 | Piccoli et al. | 340/572 |

FOREIGN PATENT DOCUMENTS

| | | | |
|---|---|---|---|
| 3609105 | 10/1987 | Germany | 340/572 |

*Primary Examiner*—Brent Swarthout
*Assistant Examiner*—Thomas J. Mullen, Jr.
*Attorney, Agent, or Firm*—Bell, Seltzer, Park & Gibson

[57] ABSTRACT

An absorbent pad comprising an upper layer of liquid impervious material, a lower layer through which liquid penetrates, an intermediate absorbent layer encapsulated between the upper and lower layers and a theft alarm activator encapsulated between the upper layer and a liquid impervious cover layer sealed to said upper layer.

9 Claims, 2 Drawing Sheets

THEFT ALARM ACTIVATING ABSORBENT PAD

FIELD OF THE INVENTION

The present invention relates to an absorbent pad and more particularly to an absorbent pad for use in receptacles of products subject to liquids being absorbed within the package.

BACKGROUND OF THE INVENTION

It is conventional practice to display certain products in individual packages with an absorbent pad in the bottom of the package either to absorb liquids exuded from the product in the package or to absorb liquids prior to packaging of the product to provide an atmosphere of high relative humidity within the package. Conventionally, such a package comprises a supporting tray with an absorbent pad in the bottom of the tray, the product being packaged resting on top of the absorbent pad and an overwrap of liquid impervious plastic film covering both the product and the supporting tray and confining the product and absorbent pad therein.

Certain products, such as flowers and certain vegetables, etc., have increased shelf life if an atmosphere of high humidity is maintained within the package. To this end, an absorbent pad, which has previously been soaked in a liquid, is included in the bottom of the package. The soaked pad maintains an atmosphere of high humidity within the package once the liquid impervious overwrap is placed therearound.

Most commonly, food products which exude liquids therefrom, such as meat, fish and poultry, are packaged in individual packages with an absorbent pad to absorb the juices or liquids exuded from the food product. Certain of such absorbent pads for such food products have the capability of absorbing the exuded liquids and maintaining the absorbed liquids against substantial migration back to the food product to increase thereby the shelf life and to avoid spoilage or discoloration of the food product.

The merchandising of such individually packaged products has increased the likelihood of theft, particularly of the more expensive items such as meat, fish and poultry. Theft of individual packages of meat, fish and poultry from grocery supermarkets is currently costing the grocery industry millions of dollars each year. Increased security has not proven to be the answer to this problem since such increased security greatly increases labor costs and has generally been ineffective.

With the foregoing in mind, it is an object of the present invention to provide an inexpensive, nonvisible means for activating or triggering theft alarm systems for such product packages.

It is a more specific object of this invention to incorporate a theft alarm activating or triggering means in the absorbent pad used in such individual product packages.

SUMMARY OF THE INVENTION

The foregoing objects of the present invention are accomplished by providing an absorbent pad comprising an upper layer, a lower layer through which liquid can penetrate, an intermediate absorbent layer encapsulated between the upper and lower layers and a theft alarm activating means sealingly mounted on the upper layer of the pad. The theft alarm activating means may take the form of a thin member or strip of magnetic material positioned between the upper layer, which is formed of liquid impervious material, and a liquid impervious cover layer sealed to the upper layer to encapsulate the theft alarm activating member within a liquid impervious pocket.

BRIEF DESCRIPTION OF THE DRAWINGS

Some of the objects and advantages of the present invention having been stated, others will appear as the description proceeds when considered in conjunction with the accompanying schematic drawings, in which.

DETAILED DESCRIPTION OF THE PREFERRED EMBODIMENTS

Figure 1:
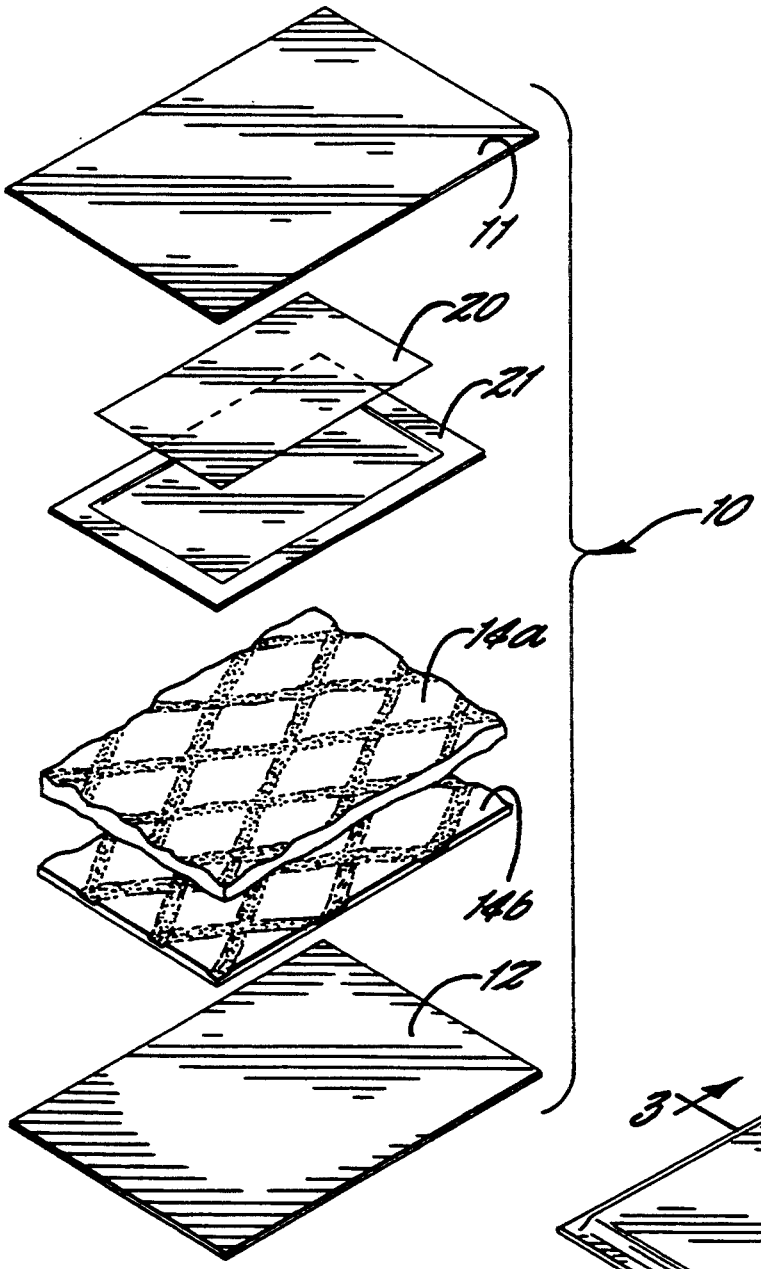
FIG. 1 is an exploded perspective view of one embodiment of the theft alarm activating absorbent pad of the present invention.
Figure 2:
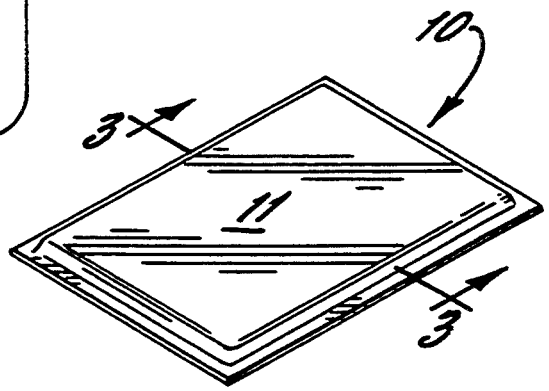
FIG. 2 is a reduced scale perspective view of the pad shown in FIG. 1 in assembled form.
Figure 3:
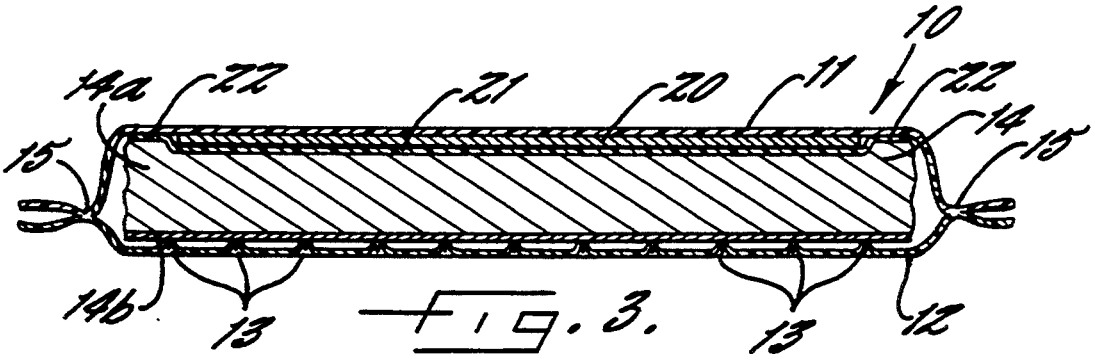
FIG. 3 is an enlarged, transverse sectional view taken substantially along line 3—3 in FIG. 2.

Referring now more particularly to the drawings, there is illustrated in FIGS. 1, 2 and 3 a first embodiment of the theft alarm activating pad of the present invention, which is generally indicated at 10. Pad 10 includes an upper layer 11, which has at least a portion thereof formed of liquid impervious material. Preferably, upper layer 10 is formed throughout of liquid impervious material, such as polyethylene plastic film. However, the present invention contemplates that certain portions of upper layer 11 could be formed to permit liquid to penetrate therethrough, such as by having a plurality of perforations formed therein (not shown).

Pad 10 also includes a lower layer 12 which is suitably formed so that liquids can penetrate therethrough into the interior of pad 10. As illustrated in FIG. 3, lower layer 12 is formed of a suitable plastic film, such as polyethylene, and has a plurality of perforations 13 formed therein. Preferably, the perforations 13 are formed substantially throughout the layer 12.

An intermediate layer 14 is disposed between upper layer 11 and lower layer 12 and is formed of any suitable material capable of absorbing many times its own weight in liquids. One such material is wood fluff, with or without the incorporation of superabsorbents therein. Preferably, intermediate layer 14 is formed of a first portion **14*a* of wood fluff and a second barrier portion 14*b* of tissue positioned between first portion 14*a* and lower layer 12 so as to prevent the short, fine wood fluff fibers from sifting out through the perforations 13 in layer 12**.

Layers 11 and 12 are secured together around at least a portion of their periphery outwardly of the absorbent layer 14 as is indicated at 15 in FIG. 3. Preferably, layers 11 and 12 are secured together completely around their outer periphery to encapsulate the absorbent layer 14 therebetween and to prevent any substantial reverse migration of liquid absorbed within layer 14 back onto the product packaged with the absorbent pad 10.

A theft alarm activating or triggering means 20 is incorporated in pad 10. As illustrated in FIG. 3, theft alarm activating means 20 is in the form of a thin member or strip of material responsive to an induced electrical or flux field, which is positioned contiguous to the lower surface of upper layer 11 in a medial portion thereof. Preferably, theft alarm activating member 20' comprises a thin strip of magnetic material responsive to a flux field for emitting a signal recognized by the anti-theft system that provides the flux field. A liquid impervious cover layer 21 covers the theft alarm activating member 20 and is sealed to the lower surface of the upper layer 12 around the periphery thereof as indicated at 22 in FIG. 3. The theft alarm activating member is thus sealed within a liquid impervious pocket between upper layer 11 and cover layer 21 to prevent exudants from contacting the theft alarm activating member 20 or the member 20 from contaminating a food product.

Figure 4:
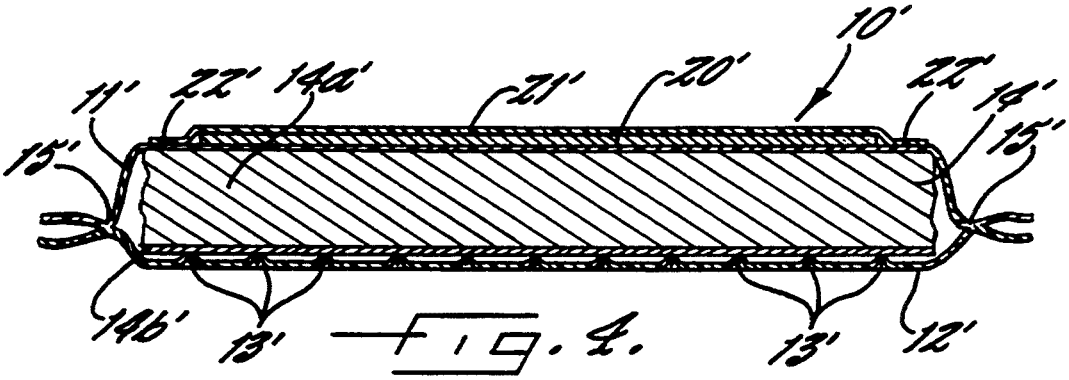
FIG. 4 is a view similar to FIG. 3 of another embodiment of the theft alarm activating pad of this invention.

Referring now to FIG. 4, there is shown another embodiment of the present invention in which like reference characters are used for like parts with the prime notation added. An absorbent pad 10' includes an upper layer 14', a lower layer 12', and an intermediate absorbent layer 14'. The lower layer 12' has a plurality of perforations 13' therein and the absorbent layer 14' includes a first portion **14*a'* of wood fluff fibers and a second barrier portion 14*b'* of tissue between the wood fluff portion 14*a'* and the lower layer 12'**.

A theft alarm activating member 20' of a material responsive to an induced electrical or flux field is positioned contiguous to the outer surface of upper layer 11'. Preferably, theft alarm activating member 20' comprises a thin strip of magnetic material responsive to a flux field for emitting a signal recognized by the anti-theft system that provides the flux field. A cover layer 21' of liquid impervious material is positioned in covering relation to the theft alarm activating member 21' and is sealed to the outer surface of the upper layer 11' around theft alarm activating member 20', as indicated at 22' in FIG. 4.

Figure 5:
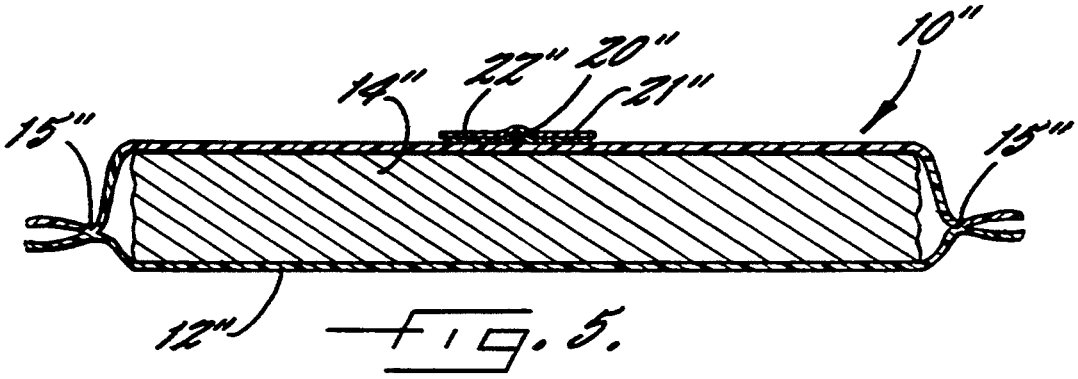
FIG. 5 is a view similar to FIGS. 3 and 4 of still another embodiment of the theft alarm activating absorbent pad of the present invention.

A still further embodiment of the present invention is illustrated in FIG. 5 in which like reference characters are used to indicate like parts with the double prime notation added. An absorbent pad 10'' includes an upper layer 11'' formed of a liquid impervious material such as polyethylene and a lower layer 12'' formed of a suitable absorbent material through which liquid can penetrate. Preferably, lower layer 12'' is formed of wet strength tissue paper. An absorbent layer 14'' is incorporated between upper and lower layers 11'' and 12'', and the upper and lower layers 11'', and 12'' are suitably secured together around the periphery thereof as indicated at 15'' in FIG. 5.

A theft alarm activating member 20'', in the form of a thin wire of magnetic material or non-magnetic material responsive to an electrical field, is positioned medially of and contiguous with the outer surface of upper layer 11''. A relatively narrow cover layer 21'' is positioned in covering relation thereto, and is suitably sealed to the outer surface of upper layer 11'' as indicated at 22''.

In use, the absorbent pad 10, 10' or 10'' of the present invention may be utilized in connection with product packages which need a high relative humidity within the package or in which there is a need for the absorption of liquids exuded from the package product. In such use, the pad 10 is positioned within a suitable supporting tray with the lower layer 12, 12' or 12'' in contact with the upper surface of the bottom wall of the tray. The product is then placed within the tray on top of the upper layer 11, and a suitable overwrap completes the package.

Until deactivated, the theft alarm activating means 20, 20' or 20'' will prevent the removal of the package containing the absorbent pad 10, 10' or 10'' from a store having a theft alarm system installed therein. The theft alarm activating means 20 can be deactivated by a suitable device provided for removing the magnetic properties from the theft alarm activating means 20, as is well known to those skilled in this art.

In the drawings and specifications, there have been set forth preferred embodiments of the invention, and although specific terms are employed, they are used in a generic and descriptive sense only and not for purposes of limitation.

That which is claimed is:

1. An alarm activating absorbent pad for inhibiting theft of a product package in which such pad is used, said pad comprising an upper layer, at least a portion of which is formed of liquid impervious material, a lower layer, at least a portion of which is formed of liquid permeable material, an intermediate layer of absorbent material for absorbing liquid therein, said upper and lower layers being secured together at least partially around their periphery outwardly of said intermediate layer, means for triggering a theft alarm system positioned adjacent to said liquid impervious portion of said upper layer, and a liquid impervious layer covering said theft alarm triggering means and the periphery of said covering layer being sealed to said upper layer to confine said theft alarm activating means between said upper layer and said covering layer, whereby said absorbent pad is adapted to be placed in a product package to absorb liquid while inhibiting theft of the product package.

2. An absorbent pad according to claim 1 wherein said upper layer is formed entirely of a liquid impervious material.

3. An absorbent pad according to claim 1 wherein said lower layer is formed of a liquid impervious material and has a plurality of perforations therein through which liquid penetrates.

4. An absorbent pad according to claim 1 wherein said lower layer is formed of wet strength tissue paper.

5. An absorbent pad according to claim 1 wherein said theft alarm triggering means comprises a thin strip formed of material responsive to an induced electrical or flux field.

6. An absorbent pad according to claim 5 wherein said theft alarm triggering strip and said covering layer are mounted on the outside surface of said upper layer.

7. An absorbent pad according to claim 5 wherein said theft alarm triggering strip and said covering layer are mounted on the inside surface of said upper layer.

8. An absorbent pad according to claim 5 wherein said theft alarm triggering strip comprises a thin flat strip of magnetic material.

9. An absorbent pad according to claim 5 wherein said theft alarm triggering strip comprises a wire of magnetic material of predetermined length.

* * * * *